US011898335B2

(12) United States Patent
Ni et al.

(10) Patent No.: US 11,898,335 B2
(45) Date of Patent: Feb. 13, 2024

(54) SHOWER ASSEMBLY WITH ADJUSTABLE WATER DELIVERY ANGLE

(71) Applicant: Xiamen Delmei Sanitary Ware Co., Ltd., Fujian (CN)

(72) Inventors: Changzheng Ni, Fujian (CN); Yongqiang Yan, Jiangxi (CN); Chunhua Wang, Fujian (CN); Pingqing Zhang, Fujian (CN)

(73) Assignee: Xiamen Delmei Sanitary Ware Co., Ltd., Xiamen (CN)

( * ) Notice: Subject to any disclaimer, the term of this patent is extended or adjusted under 35 U.S.C. 154(b) by 16 days.

(21) Appl. No.: 17/868,534

(22) Filed: Jul. 19, 2022

(65) Prior Publication Data

US 2023/0392358 A1 Dec. 7, 2023

(30) Foreign Application Priority Data

Jun. 1, 2022 (CN) ..... 202210525920.X

(51) Int. Cl.
*E03C 1/06* (2006.01)

(52) U.S. Cl.
CPC ..... *E03C 1/066* (2013.01)

(58) Field of Classification Search
CPC ..... E03C 1/066
USPC ..... 4/567, 570, 601, 615
See application file for complete search history.

(56) References Cited

U.S. PATENT DOCUMENTS

| | | | | |
|---|---|---|---|---|
| 7,458,112 | B1 * | 12/2008 | Yang | E03C 1/066 4/570 |
| 8,683,624 | B1 * | 4/2014 | Zhadanov | E03C 1/066 4/615 |
| 2023/0104710 | A1 * | 4/2023 | Zhadanov | B05B 15/62 4/615 |
| 2023/0235542 | A1 * | 7/2023 | Chen | E03C 1/06 4/570 |

* cited by examiner

*Primary Examiner* — Tuan N Nguyen

(57) ABSTRACT

The present invention provides a shower assembly with an adjustable water delivery angle, including: an inlet water pipe, having an inlet water channel and a first water outlet and a second water outlet, both of which are in communication with the inlet water channel; a top spray support arm, rotatably mounted on the inlet water pipe; a movable piece, movably disposed on the inlet water pipe and connecting the top spray support arm to the inlet water pipe in a limiting manner, wherein when the movable piece moves to a first position, the top spray support arm rotates around the inlet water pipe; when the movable piece moves to a second position, the top spray support arm is limited along a circumference of the inlet water pipe, wherein the movable piece is provided with a first magnetic attraction element.

10 Claims, 4 Drawing Sheets

SHOWER ASSEMBLY WITH ADJUSTABLE WATER DELIVERY ANGLE

CROSS-REFERENCE TO RELATED APPLICATION

This application claims priority from the Chinese patent application 202210525920.X filed Jun. 1, 2022, the content of which is incorporated herein in the entirety by reference.

TECHNICAL FIELD

The present disclosure relates to the field of bathrooms and in particular to a shower assembly with an adjustable water delivery angle.

BACKGROUND

In the prior art, a top spray of a shower assembly is typically fixedly disposed and thus cannot be adjusted in angle and height. Therefore, the top spray cannot be adjusted according to actual requirements of a user, resulting in a poor user experience. Further, a shower head of a conventional shower assembly is usually placed on a shower head seat with a hanging hole, requiring the user to accurately find the position of the hanging hole during use and resulting in inconvenient operation.

SUMMARY

The present disclosure provides a shower assembly with an adjustable water delivery angle. In this solution, a movable piece is disposed to enable a top spray support arm to be limited or positioned so as to adjust a water delivery angle and a height of the top spray support arm, and the movable piece is provided with a first magnetic attraction element such that a shower head can be hung on the movable piece in a magnetic attraction manner, resulting in convenient operation, and simple and compact structure.

In order to achieve the above purpose, the present disclosure adopts the following solution.

There is provided a shower assembly with an adjustable water delivery angle, including:

an inlet water pipe, having an inlet water channel and a first water outlet and a second water outlet, both of which are in communication with the inlet water channel;

a top spray support arm, rotatably mounted on the inlet water pipe, wherein the top spray support arm is provided with a top spray channel in communication with the first water outlet;

a movable piece, movably disposed on the inlet water pipe and connecting the top spray support arm to the inlet water pipe in a limiting manner, wherein when the movable piece moves to a first position, the top spray support arm rotates around the inlet water pipe; when the movable piece moves to a second position, the top spray support arm is limited along a circumference of the inlet water pipe, wherein the movable piece is provided with a first magnetic attraction element; and a shower head, having a shower head channel in communication with the second water outlet, wherein the shower head is provided with a second magnetic attraction element attractable with the first magnetic attraction element.

Preferably, the top spray support arm is provided with a clamping portion, and the inlet water pipe is provided with a limiting portion. When the movable piece moves to the first position, the top spray support arm moves away from the inlet water pipe so as to enable the clamping portion to be in yielding cooperation with the limiting portion; when the movable piece moves to the second position, the top spray support arm moves close to the inlet water pipe so as to enable the clamping portion to be in limiting cooperation with the limiting portion.

Preferably, the clamping portion is a first clamping collar disposed on the top spray support arm, and the limiting portion is a plurality of clamping teeth disposed along the circumference of the inlet water pipe.

Preferably, the movable piece includes an insertion shaft and a limiting ring, and the top spray support arm is provided with a pivoting hole. The insertion shaft is inserted through the pivoting hole to connect with the inlet water pipe, and the limiting ring is in a limiting cooperation with a hole wall of the pivoting hole to connect the top spray support arm to the inlet water pipe in a limiting manner.

Preferably, the insertion shaft is provided with a first thread portion, and the inlet water pipe is provided with a second thread portion. When the movable piece rotates reversely, the movable piece is enabled to move away from the inlet water pipe to the first position by cooperation of the first thread portion and the second thread portion; when the movable piece rotates forward, the movable piece is enabled to move close to the inlet water pipe to the second position by cooperation of the first thread portion and the second thread portion.

Preferably, the inlet water pipe is further provided with a C-shaped buckle capable of limiting the first thread portion so as to prevent the movable piece from separating from the inlet water pipe.

Preferably, the inlet water pipe is further connected with a switching valve and the inlet water channel switches water supply for the first water outlet and the second water outlet under the action of the switching valve.

Preferably, a rubber pad is further disposed between the movable piece and the top spray support arm to provide a frictional force for rotation of the top spray support arm.

Preferably, an elastic piece is further disposed between the movable piece and the top spray support arm to provide a pre-tightening force for rotation of the top spray support arm.

Preferably, the inlet water pipe is fixedly mounted on a wall body and the first magnetic attraction element is a magnetic ring fixedly mounted on an outer end of the movable piece.

The present disclosure has the following beneficial effects.

1. The shower assembly with an adjustable water delivery angle according to the present disclosure includes: an inlet water pipe, having an inlet water channel and a first water outlet and a second water outlet, both of which are in communication with the inlet water channel; a top spray support arm, rotatably mounted on the inlet water pipe; a movable piece, movably disposed on the inlet water pipe and connecting the top spray support arm to the inlet water pipe in a limiting manner, wherein when the movable piece moves to a first position, the top spray support arm rotates around the inlet water pipe; when the movable piece moves to a second position, the top spray support arm is limited along a circumference of the inlet water pipe, wherein the movable piece is provided with a first magnetic attraction element; and a shower head, provided with a second magnetic attraction element attractable with the first magnetic attraction element. In this solution, by disposing the movable piece, the top spray support arm is limited or positioned to adjust the water delivery angle and the height of the top spray support arm, and the moveable piece is provided with the first magnetic attraction element such that the shower head can be hung on the movable piece via magnetic attraction, resulting in convenient operation and a simple and compact structure.

2. The rubber pad is disposed between the movable piece and the top spray support arm to provide a frictional force for rotation of the top spray support arm, thus preventing the top spray support arm from uncontrollably deflecting.

3. The elastic piece is disposed between the movable piece and the top spray support arm to provide a pre-tightening force for the top spray support arm, thus preventing the top spray support arm from uncontrollably deflecting.

BRIEF DESCRIPTIONS OF THE DRAWINGS

The accompanying drawings described herein are provided for further understanding of the present invention and constitute a part of the present invention. The illustrative embodiments of the present invention and its descriptions are used to explain the present invention rather than constitute limitation to the present invention.

The numerals of the drawings are described as follows: 10. inlet water pipe, 11. inlet water channel, 12. first water outlet, 13. second water outlet, 14. limiting portion, 15. second thread portion, 16. C-shaped buckle, 17. switching valve, 20. top spray support arm, 21. top spray channel, 22. clamping portion, 23. pivoting hole, 30. movable piece, 31. first magnetic attraction element, 32. insertion shaft, 321. first thread portion, 33. limiting ring, 40. rubber pad.

DETAILED DESCRIPTIONS OF EMBODIMENTS

In order to make the technical problems, technical solutions and beneficial effects of the present d clearer and more understandable, the present invention will be further described in details in combination with the accompanying drawings and the embodiments. It should be understood that the specific embodiments described herein are used only to explain the present invention rather than limit the present invention.

Embodiment 1

Figure 1:
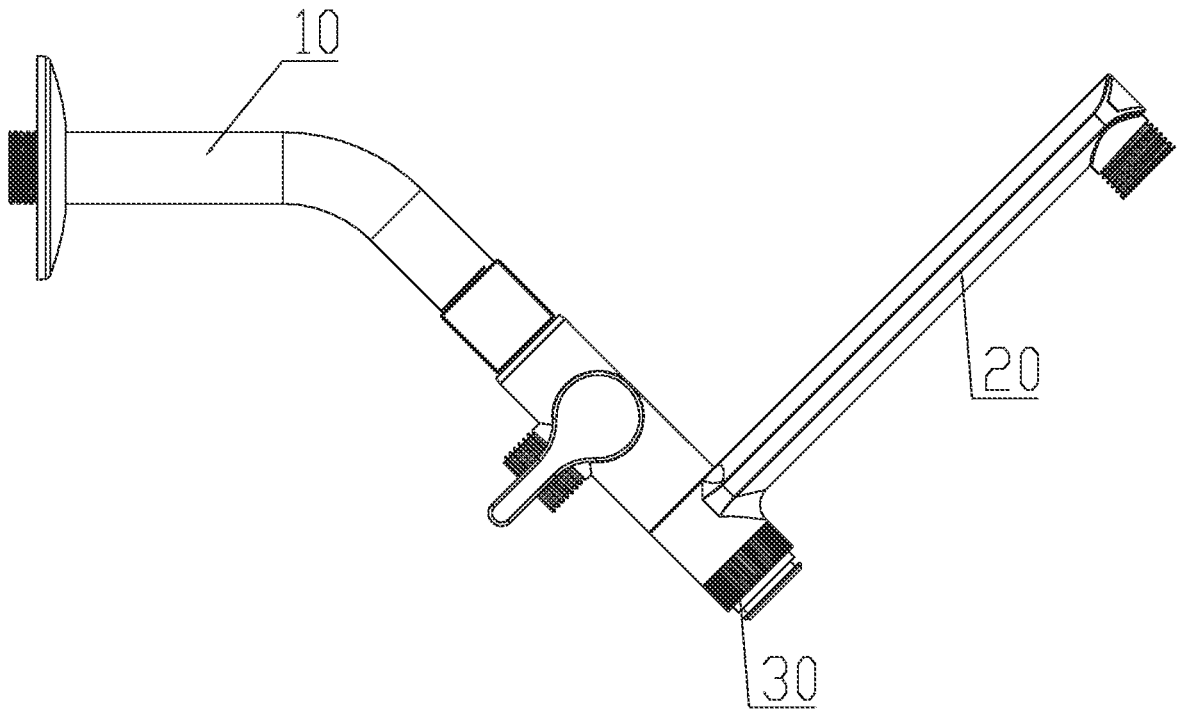
FIG. 1 is a stereoscopic diagram illustrating a shower assembly with an adjustable water delivery angle according to a first embodiment of the present invention.
Figure 2:
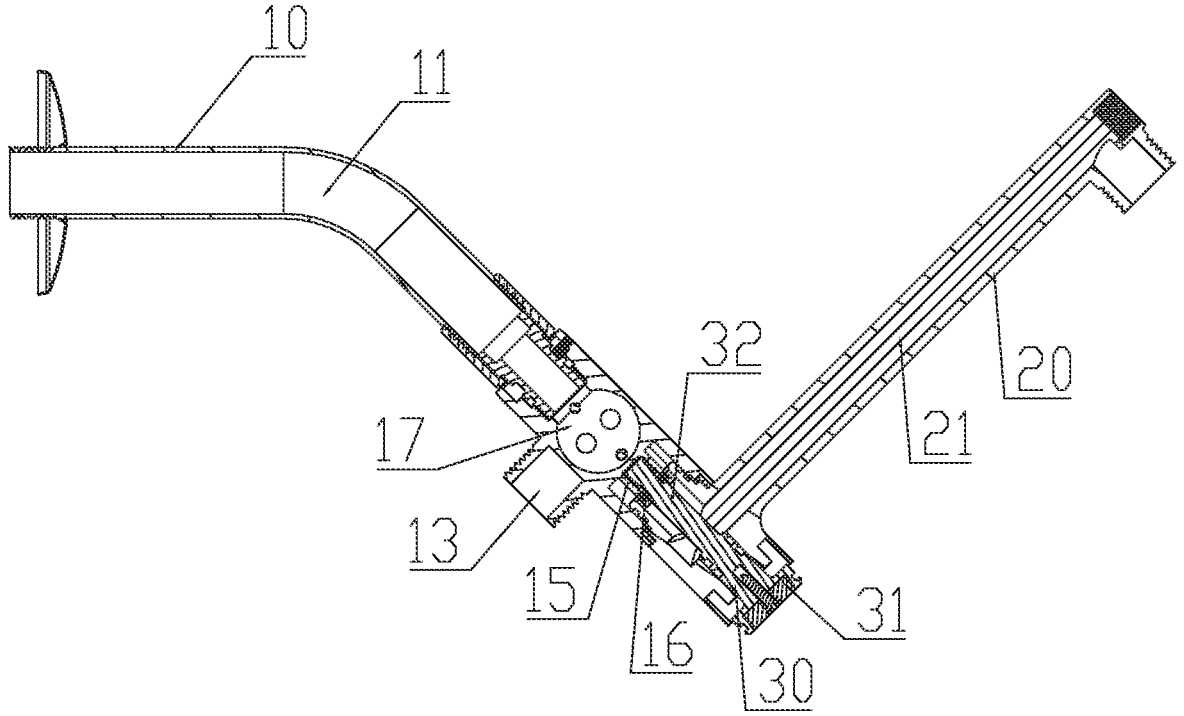
FIG. 2 is a sectional diagram illustrating a shower assembly with an adjustable water delivery angle according to a first embodiment of the present invention.
Figure 3:
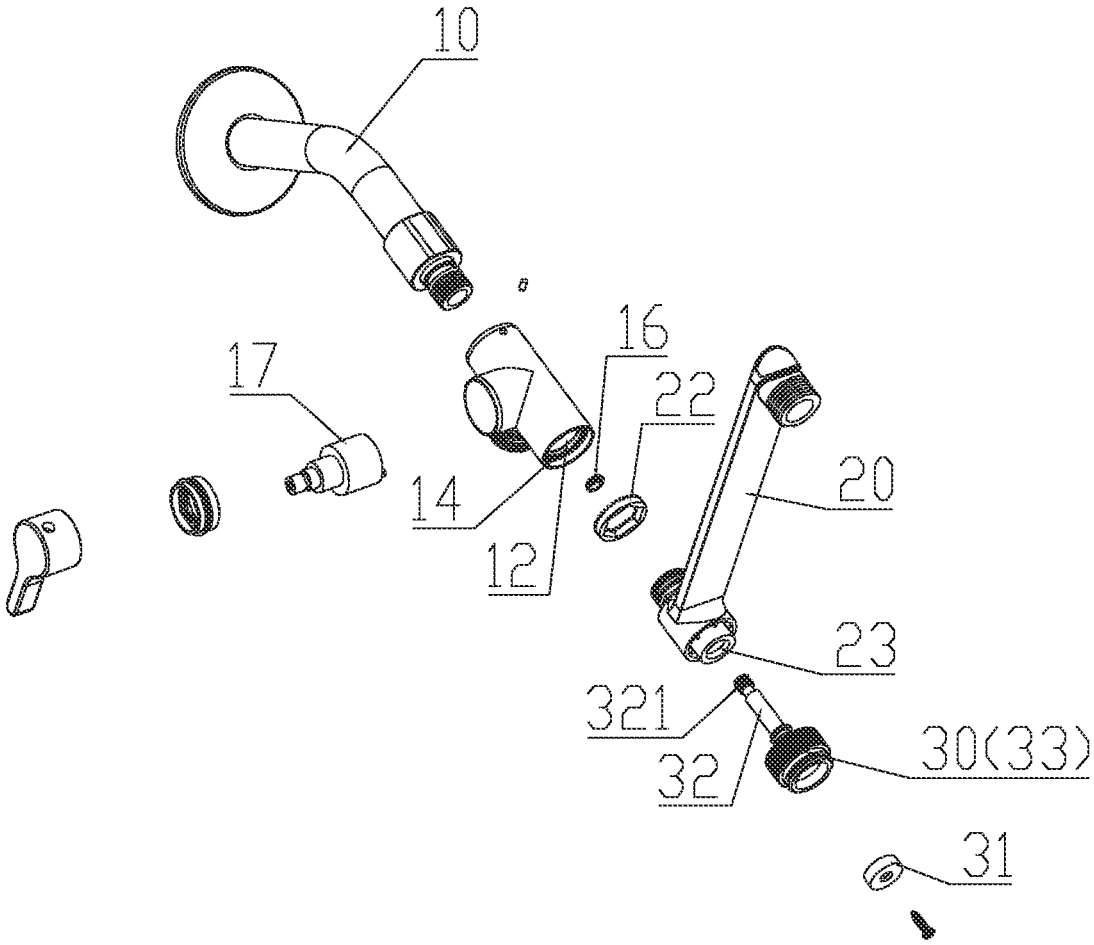
FIG. 3 is an exploded view illustrating a shower assembly with an adjustable water delivery angle according to a first embodiment of the present invention.

As shown in FIGS. 1 to 3, a shower assembly is provided with an adjustable water delivery angle, including:

an inlet water pipe 10, having an inlet water channel 11 and a first water outlet 12 and a second water outlet 13, both of which are in communication with the inlet water channel 11;

a top spray support arm 20, rotatably mounted on the inlet water pipe 10, wherein the top spray support arm 20 is provided with a top spray channel 21 in communication with the first water outlet 12;

a movable piece 30, movably disposed on the inlet water pipe 10 and connecting the top spray support arm 20 to the inlet water pipe 10 in a limiting manner, wherein when the movable piece 30 moves to a first position, the top spray support arm 20 rotates around the inlet water pipe 10; when the movable piece 30 moves to a second position, the top spray support arm 20 is limited along a circumference of the inlet water pipe 10, wherein the movable piece 30 is provided with a first magnetic attraction element 31; and a shower head, having a shower head channel in communication with the second water outlet 13, wherein the shower head is provided with a second magnetic attraction element attractable with the first magnetic attraction element 31.

In this embodiment, the top spray support arm 20 is provided with a clamping portion 22, and the inlet water pipe 10 is provided with a limiting portion 14. When the movable piece moves to the first position, the top spray support arm 20 moves away from the inlet water pipe 10 so as to enable the clamping portion 22 to be in yielding cooperation with the limiting portion 14; when the movable piece 30 moves to the second position, the top spray support arm moves close to the inlet water pipe 10 so as to enable the clamping portion 22 to be in limiting cooperation with the limiting portion 14.

In this embodiment, the clamping portion 22 is a first clamping collar disposed on the top spray support arm 20, and the limiting portion 14 is a plurality of clamping teeth disposed along the circumference of the inlet water pipe 10.

In this embodiment, the movable piece 30 includes an insertion shaft 32 and a limiting ring 33 and the top spray support arm 20 is provided with a pivoting hole 23. The insertion shaft 32 is inserted through the pivoting hole 23 to connect with the inlet water pipe 10, and the limiting ring 33 is in a limiting cooperation with a hole wall of the pivoting hole 23 to connect the top spray support arm 20 to the inlet water pipe 10 in a limiting manner.

In this embodiment, the insertion shaft 32 is provided with a first thread portion 321, and the inlet water pipe 10 is provided with a second thread portion 15. When the movable piece 30 rotates in reverse, the movable piece 30 moves away from the inlet water pipe 10 to the first position by cooperation of the first thread portion 321 and the second thread portion 15; when the movable piece 30 rotates forward, the movable piece 30 moves close to the inlet water pipe 10 to the second position by cooperation of the first thread portion 321 and the second thread portion 15. In this embodiment, the first thread portion 321 is an external thread disposed on an outer wall of the insertion shaft 32, and the second thread portion 15 is a thread hole disposed on the inlet water pipe 10.

In this embodiment, the inlet water pipe 10 is further provided with a C-shaped buckle 16 capable of limiting the first thread portion 321 so as to prevent the movable piece 30 from separating from the inlet water pipe 10.

In this embodiment, the inlet water pipe 10 is further connected with a switching valve 17 and the inlet water channel 11 switches water supply for the first water outlet 12 and the second water outlet 13 under the action of the switching valve 17.

In this embodiment, the inlet water pipe 10 is fixedly mounted on a wall body and the first magnetic attraction element 31 is a magnetic ring fixedly mounted on an outer end of the movable piece 30.

The specific working process of the embodiment is as follows:

the movable piece 30 is rotated in reverse to enable the movable piece 30 to move to the first position and at this time, the top spray support arm 20 can move away from the inlet water pipe 10 so as to enable the clamping portion 22 to be in yielding cooperation with the limiting portion 14 and at this time, the top spray support arm 20 can be rotated to a proper angle or height;

the movable piece 30 is rotated forward to enable the movable piece 30 to move to the second position, and at this time, the top spray support arm 20 can move close to the inlet water pipe 10 so as to enable the clamping portion 22 to be in limiting cooperation with the limiting portion 14, and thus the top spray support arm 20 is positioned at the current position.

In this solution, the movable piece 10 is disposed to enable the top spray support arm 20 to be limited or positioned so as to adjust a water delivery angle and a height of the top spray support arm 20, and the movable piece 30 is provided with the first magnetic attraction element 31 such that the shower head can be hung on the movable piece 30 in a magnetic attraction manner, resulting in convenient operation, and simple and compact structure.

Embodiment 2

Figure 4:
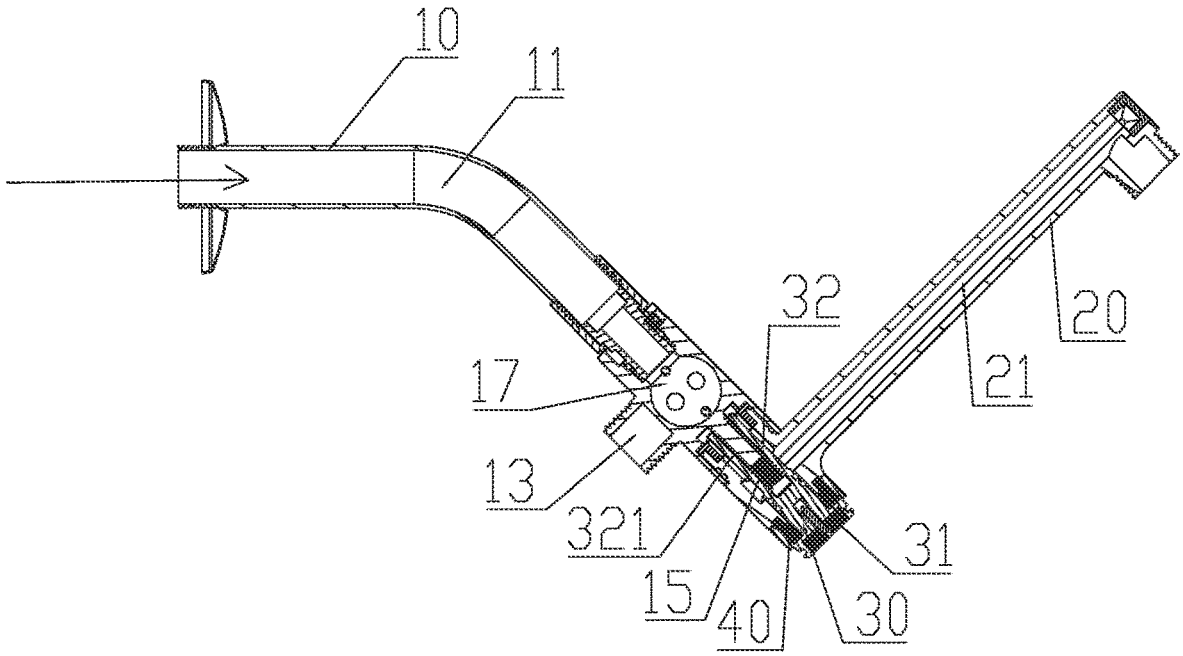
FIG. 4 is a sectional diagram illustrating a shower assembly with an adjustable water delivery angle according to a second embodiment of the present invention.

As shown in FIG. 4, the embodiment differs from the first embodiment mainly in the following major points: a rubber pad 40 is further disposed between the movable piece 30 and the top spray support arm 20 to provide a frictional force for rotation of the top spray support arm 20, further preventing the top spray support arm 20 from deflecting uncontrollably.

In this embodiment, the first thread portion 321 is a thread hole on the insertion shaft 32, and the second thread portion 15 is a bolt disposed on the inlet water pipe.

Other parts not mentioned herein are same as in the first embodiment and will not be repeated herein.

Embodiment 3

The embodiment differs from the first embodiment mainly in the following major points: an elastic piece is further disposed between the movable piece 30 and the top spray support arm 20 to provide a pre-tightening force for rotation of the top spray support arm 20. Specifically, the elastic piece is a reset spring abutted between the movable piece 30 and the top spray support arm 20 to prevent the top spray support arm 20 from uncontrollably deflecting.

Other parts not mentioned herein are same as in the first embodiment and will not be repeated herein.

The above describes and illustrates preferred embodiments of the present invention. As mentioned above, it should be understood that the present invention is not limited to the forms disclosed herein nor regarded as exclusive to other embodiments but can be applied to various other combinations, modifications and environments. Further, the present invention may be changed or modified based on the above teachings or technologies or knowledge of relevant fields within the conceived scope of the present invention. The changes and modifications made by those skilled in the art without departing from the scope and spirit of the present invention shall all fall within the scope of protection of the appended claims of the present invention.

What is claimed is:

1. A shower assembly with an adjustable water delivery angle, comprising:

an inlet water pipe, having an inlet water channel and a first water outlet and a second water outlet, both of which are in communication with the inlet water channel;

a top spray support arm, rotatably mounted on the inlet water pipe, wherein the top spray support arm is provided with a top spray channel in communication with the first water outlet;

a movable piece, movably disposed on the inlet water pipe and connecting the top spray support arm to the inlet water pipe in a limiting manner, wherein when the movable piece moves to a first position, the top spray support arm rotates around the inlet water pipe; when the movable piece moves to a second position, the top spray support arm is limited along a circumference of the inlet water pipe, wherein the movable piece is provided with a first magnetic attraction element; and a shower head, having a shower head channel in communication with the second water outlet, wherein the shower head is provided with a second magnetic attraction element attractable with the first magnetic attraction element.

2. The shower assembly of claim 1, wherein the top spray support arm is provided with a clamping portion, and the inlet water pipe is provided with a limiting portion; when the movable piece moves to the first position, the top spray support arm moves away from the inlet water pipe so as to enable the clamping portion to be in yielding cooperation with the limiting portion; when the movable piece moves to the second position, the top spray support arm moves close to the inlet water pipe so as to enable the clamping portion to be in limiting cooperation with the limiting portion.

3. The shower assembly of claim 2, wherein the clamping portion is a first clamping collar disposed on the top spray support arm, and the limiting portion is a plurality of clamping teeth disposed along the circumference of the inlet water pipe.

4. The shower assembly of claim 2, wherein the movable piece comprises an insertion shaft and a limiting ring, the top spray support arm is provided with a pivoting hole, the insertion shaft is inserted through the pivoting hole to connect with the inlet water pipe, and the limiting ring is in a limiting cooperation with a hole wall of the pivoting hole to connect the top spray support arm to the inlet water pipe in a limiting manner.

5. The shower assembly of claim 4, wherein the insertion shaft is provided with a first thread portion, and the inlet water pipe is provided with a second thread portion, wherein when the movable piece rotates reversely, the movable piece is enabled to move away from the inlet water pipe to the first position by cooperation of the first thread portion and the second thread portion; when the movable piece rotates forward, the movable piece is enabled to move close to the inlet water pipe to the second position by cooperation of the first thread portion and the second thread portion.

6. The shower assembly of claim 5, wherein the inlet water pipe is further provided with a C-shaped buckle capable of limiting the first thread portion to prevent the movable piece from separating from the inlet water pipe.

7. The shower assembly of claim 1, wherein the inlet water pipe is further connected with a switching valve and the inlet water channel switches water supply for the first water outlet and the second water outlet under the action of the switching valve.

8. The shower assembly of claim 1, wherein a rubber pad is further disposed between the movable piece and the top spray support arm to provide a frictional force for rotation of the top spray support arm.

9. The shower assembly of claim 1, wherein an elastic piece is further disposed between the movable piece and the top spray support arm to provide a pre-tightening force for rotation of the top spray support arm.

10. The shower assembly of claim 1, wherein the inlet water pipe is fixedly mounted on a wall body and the first magnetic attraction element is a magnetic ring fixedly mounted on an outer end of the movable piece.

* * * * *